US005440780A

United States Patent [19]

Rakocy et al.

[11] Patent Number: 5,440,780

[45] Date of Patent: Aug. 15, 1995

[54] TIP-RESISTANT CANISTER FOR UPRIGHT VACUUM CLEANERS

[75] Inventors: William J. Rakocy, Madison, Conn.; Thomas Angelini, Sebring, Ohio

[73] Assignee: GMI Holdings, Inc., Alliance, Ohio

[21] Appl. No.: 164,154

[22] Filed: Dec. 9, 1993

Related U.S. Application Data

[63] Continuation-in-part of Ser. No. 11,448, Aug. 4, 1993.

[51] Int. Cl.[6] ..... A47L 5/36

[52] U.S. Cl. ..... 15/327.2; 15/327.6; 15/353

[58] Field of Search ..... 15/353, 352, 327.6, 15/327.2, 327.1

[56] References Cited

U.S. PATENT DOCUMENTS

| | | | |
|---|---|---|---|
| Re. 34,130 | 11/1992 | Berfield et al. | 280/79.5 |
| D. 178,199 | 7/1956 | Martinec | D9/2 |
| D. 200,526 | 3/1965 | Medley | D9/2 |
| D. 200,760 | 4/1965 | Medley | D9/2 |
| D. 242,870 | 12/1976 | Mocarski | D15/62 |
| D. 244,523 | 5/1977 | Ebalo | D15/62 |
| D. 260,151 | 8/1981 | Martinec | D15/62 |
| D. 286,336 | 10/1986 | Berfield et al. | D32/23 |
| D. 287,895 | 1/1987 | Berfield et al. | D32/25 |
| D. 292,336 | 10/1987 | Kieft et al. | D32/23 |
| D. 338,294 | 8/1993 | Köhler | D32/23 |
| 2,177,153 | 10/1939 | Ross et al. | 280/61 |
| 2,233,167 | 2/1941 | Holm-Hansen | 15/327.6 X |
| 2,333,017 | 10/1943 | Leathers | 230/132 |
| 2,543,697 | 2/1951 | Lanter | 280/61 |
| 2,573,085 | 10/1951 | Yonkers | 280/61 |
| 2,607,945 | 8/1952 | Fontaine | 15/257 |
| 2,611,149 | 9/1952 | Levy | 15/327 |
| 2,740,981 | 4/1956 | Famolare et al. | 15/257 |
| 2,862,220 | 12/1958 | Orr | 15/257 |
| 2,863,524 | 12/1958 | Buda | 183/37 |
| 2,917,769 | 12/1959 | Kasper | 15/323 |
| 2,920,337 | 1/1960 | Smith | 15/323 |
| 3,013,807 | 12/1961 | Winterhoff | 15/327 |
| 3,048,961 | 8/1962 | Kemnitz | 55/471 |
| 3,063,082 | 11/1962 | Rosenberg | 15/353 X |
| 3,365,864 | 1/1968 | Iizima | 55/471 |
| 3,381,329 | 5/1968 | Wied | 15/327.2 |
| 3,775,951 | 12/1973 | Eicholz et al. | 55/417 |
| 3,831,223 | 8/1974 | Colt et al. | 15/321 |
| 3,930,630 | 1/1976 | Wulff | 248/129 |
| 4,086,680 | 5/1978 | Kelly | 16/30 |
| 4,118,208 | 10/1978 | Klinedinst | 55/433 |
| 4,185,974 | 1/1980 | Hiester | 55/216 |
| 4,193,161 | 3/1980 | Scott | 15/352 |
| 4,222,145 | 9/1980 | Lowder | 15/353 |
| 4,280,245 | 7/1981 | Hiester | 25/326 |
| 4,342,131 | 8/1982 | Reid | 15/327 |

(List continued on next page.)

OTHER PUBLICATIONS

The 3J Company, Owners Manual for the Top Vac Wet/Dry Vacuum, Undated, 8 pages.

The 3J Company, Products brochure entitled "Top Vac 5 Gallon Wet/Dry Vac with Plastic Tank", undated, 2 pages.

8 Photographs of the Top Vac Wet/Dry Vacuum Model No. 3005.

(List continued on next page.)

*Primary Examiner*—Chris K. Moore

*Attorney, Agent, or Firm*—Leydig, Voit & Mayer, Ltd.

[57] ABSTRACT

A tip-resistant canister for use in wet/dry vacuums is disclosed. The tip-resistant canister has recessed caster supports and a skirt for resisting tipping. The recessed caster supports lower the center of gravity of the canister thereby making the canister more difficult to tip. The skirt of the canister, on the other hand, strikes the ground whenever the canister does begin to tip thereby preventing the canister from falling completely onto its side. The impact of the canister skirt against the ground also has a tendency to cause the canister to return to an upright position.

32 Claims, 6 Drawing Sheets

U.S. PATENT DOCUMENTS

| | | | |
|---|---|---|---|
| 4,462,137 | 7/1984 | Berfield et al. | 25/353 |
| 4,508,550 | 4/1985 | Berfield et al. | 55/216 |
| 4,530,543 | 7/1985 | Keane | 301/63 PW |
| 4,547,927 | 10/1985 | Berfield | 15/327 |
| 4,563,789 | 1/1986 | Berfield | 15/323 |
| 4,609,387 | 9/1986 | Berfield et al. | 55/320 |
| 4,623,366 | 11/1986 | Berfield et al. | 55/216 |
| 4,655,694 | 4/1987 | Berfield | 417/423 |
| 4,783,878 | 11/1988 | McCambridge . | |
| 4,799,286 | 1/1989 | Rubin | 15/361 |
| 4,799,699 | 1/1989 | Berfield et al. | 280/79.5 |
| 4,888,849 | 12/1989 | Hult et al. | 15/327 |
| 4,906,265 | 3/1990 | Berfield | 55/379 |
| 5,050,264 | 9/1991 | Breslin | 15/327 |
| 5,074,572 | 12/1991 | Delmerico et al. | 280/47.34 |
| 5,144,716 | 9/1992 | Watanabe et al. | 15/327.2 X |
| 5,184,041 | 2/1993 | Baer et al. | 310/239 |
| 5,295,606 | 3/1994 | Karwoski | 220/908 X |

OTHER PUBLICATIONS

Montgomery Ward Catalog, Fall/Winter 1975, p. 695, Powr Kraft Vacuum.

Hammacher Schlemmer Catalog, Spring 1986, p. 57; Wet/Dry Vacuum #22019H.

Breuer Electric Mfg. Co., 1957; Series 400 Tornado Wet/Dry Vacuum Cleaners; Stainless Tank #2651–2650.

TIP-RESISTANT CANISTER FOR UPRIGHT VACUUM CLEANERS

This patent application is a continuation-in-part of co-pending U.S. patent application Ser. No. 29/011,448, filed on Aug. 4, 1993 by William J. Rackocy and Thomas Angelini for CANISTER FOR A WET/DRY VACUUM.

FIELD OF THE INVENTION

The invention relates generally to vacuum cleaners and more particularly to canisters for upright wet/dry vacuum cleaners.

BACKGROUND OF THE INVENTION

Upright vacuum cleaners such as wet/dry vacuums are typically provided with a power head for generating a suctioning force, a hose or suctioning wand for directing the suctioning force of the power head, and a cylindrical canister for collecting the refuse suctioned through the hose. The power head is mounted upon the canister which is in turn mounted upon some sort of wheels or casters in order to facilitate moving the vacuum during use and storage. This arrangement results in a number of stability problems. For example, although the canister must also support the power head, its main purpose is to collect refuse. Consequently, the canister is typically a hollow structure with very little mass. The power head, on the other hand, includes a motor, fan and various other components for generating a suctioning force. Thus, the power head has a significant percentage of the mass of the typical upright vacuum cleaner. As a result, the typical wet/dry vacuum is extremely top heavy and can be easily tipped. While this top heavy condition generally becomes less severe as refuse collects in the bottom of the canister, wet/dry vacuums remain substantially unstable with all but the heaviest load of refuse.

This propensity for tipping is exacerbated by the manner in which wet/dry vacuums are used. As previously mentioned, wet/dry vacuums are provided with a hose or suctioning wand for directing the suctioning force generated by the power head. A user typically moves the suctioning wand from place to place positioning the wand adjacent to the area to be vacuumed. Periodically, a user who wishes to vacuum an area which is beyond the reach of the hose will use the hose to pull the wet/dry vacuum to that area. While the casters of the typical wet/dry vacuum attempt to permit the vacuum to roll under such a force, the top heavy nature of the structure can easily cause the entire unit to tip in these circumstances. Not only can this tipping result in damage to the vacuum, but it can cause the vacuum to spill its previously collected refuse and, thus, create additional work for the user.

OBJECTS OF THE INVENTION

It is therefore a general object of the invention to provide an improved tip-resistant canister for use in wet/dry vacuums. More specifically, it is an object of the invention to provide a canister for wet/dry vacuums which minimizes the tipping tendency common in upright vacuums by lowering the center of gravity of the vacuum. It is a related object of the present invention to provide a canister which tends to right itself when tipped.

SUMMARY OF THE INVENTION

The present invention accomplishes these objectives and overcomes the drawbacks of the prior art by providing a tip-resistant canister for use in upright vacuum cleaners. The tip-resistant canister includes a floor with caster supports for receiving casters and a wall connected to the floor. The bottom of the canister has a perimeter which is greater than the perimeter of the top of the canister. Thus, the bottom of the canister forms a skirt which will strike the ground if the canister begins to tip thereby tending to force the canister to return to an upright position.

In addition, the tip-resistant canister includes caster supports which are disposed in a substantially horizontal plane above the canister's floor. Casters connected to these caster supports will, consequently, be recessed with respect to the canister floor. The tip-resistant canister is thus positioned closer to the ground than a canister including non-recessed supports and casters. As a result, the tip-resistant canister has a low center of gravity and is very difficult to tip.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 2:
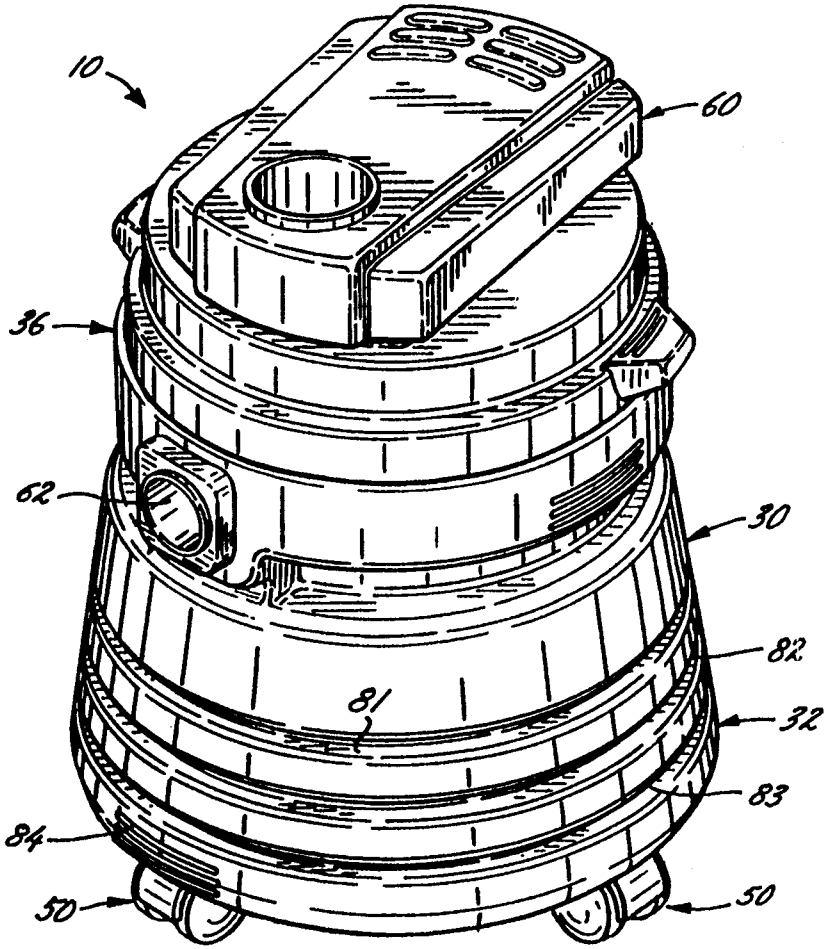
FIG. 2 is a right front perspective view of the tip-resistant canister with an attached power head.
Figure 1:
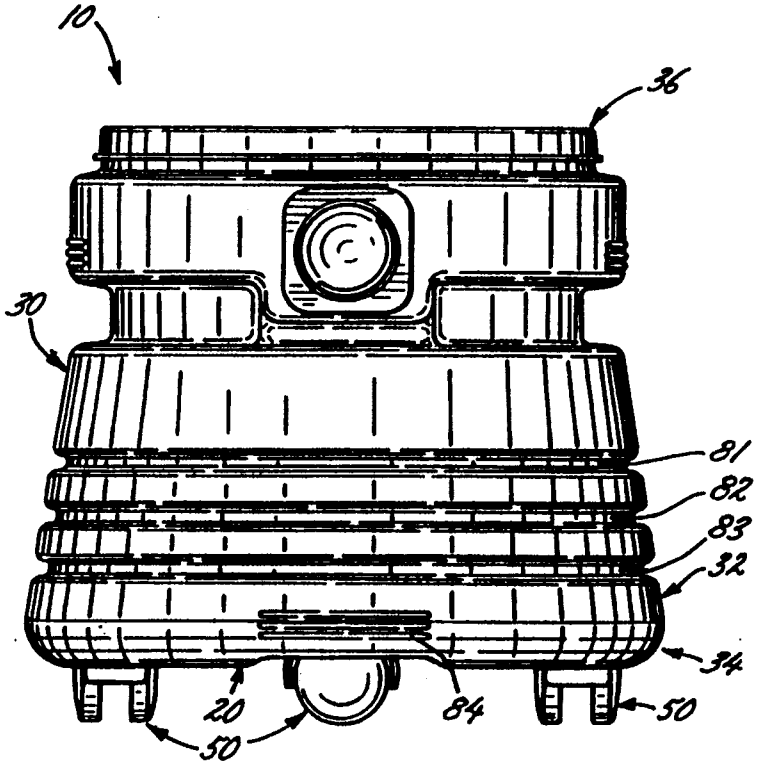
FIG. 1 is a front plan view of a tip-resistant canister constructed in accordance with the teachings of the invention.

A tip-resistant canister 10 constructed in accordance with the teachings of the invention is illustrated in FIGS. 1 and 2. As set forth below, the canister 10 has a lower center of gravity than a conventional canister. Thus, it is more difficult to tip the inventive canister 10 from an upright position than it is to tip a conventional canister. In addition, the canister is provided with a stopping feature which, in normal use, both prevents the canister 10 from falling to its side once it begins to tip, and tends to return the canister 10 to its upright position after stopping the tipping motion.

As an initial matter, it should be noted that although the inventive canister 10 will be illustrated with a power head and several casters attached, the casters and power head form no part of the invention. Rather, the power head and casters are shown and described for illustrative purposes only. Specifically, the casters and power head are included to more clearly illustrate the intended use for the inventive canister 10. Thus, it will be appreciated that the canister 10 could be used with casters and power heads of other types and designs without departing from the scope and spirit of the invention.

As illustrated in FIG. 1, the tip-resistant canister 10 includes a floor 20 and a wall 30 which together form an open-ended enclosure for containing refuse. The canister floor 20 is generally equipped to receive and support casters 50 which enable the canister 10 to roll over a surface during use and storage. The canister wall 30, on the other hand, is adapted to removably support a power head 60 as illustrated in FIG. 2. The power head 60 is typically quite heavy. It includes a motor (not shown) and an impeller (also not shown) which combine to generate a suctioning force within the canister 10 for collecting refuse through a port 62. A hose with an attached suctioning wand (not shown) is often connected to the port 62 for directing the suctioning force. Refuse can then be drawn into the canister 10 through the wand or hose until the canister 10, which gathers and holds the refuse, is full. The user can then detach the power head 60 from the canister wall 30 and empty the refuse so the process can begin again.

Preferably, the canister 10 is blow molded from plastic. However, it will be appreciated by those skilled in the art that the floor 20 and the wall 30 could also be separately constructed and then attached as long as a proper seal which enables the floor 20 and wall 30 to contain refuse without leaking is employed. Further, it will also be appreciated that the inventive canister 10 could be formed from other resilient materials or with other molding techniques such as injection molding or roto molding without departing from the invention.

In accordance with the invention, the wall 30 of the tip-resistant canister 10 includes a skirt 32 which stops the tilting motion of the canister 10 and provides a self-righting force when the canister 10 begins to tip. The skirt 32 overhangs the casters 50 such that, if the canister 10 tips beyond a certain angle, the exaggerated skirt 32 will strike the ground and stop the tipping movement before the canister falls to its side. Further, the canister 10, and thus, the exaggerated skirt 32, is preferably constructed from a resilient material such as plastic. Consequently, the skirt 32 also tends to bounce upon striking the ground thereby generating the self-righting force tending to return the canister 10 to its upright position.

Although the wall 30 of the canister can be constructed in many shapes and sizes, the lower end 34 of the wall 30 always has a larger perimeter than the upper end 36 of the wall. In other words, the wall 30 flares out at its lower end 34 to form an exaggerated skirt 32. Further, the wall 30 is preferably symmetrical about the vertical axis of the canister 10. Even more preferably, the wall 30 has a substantially circular horizontal cross-section. Thus, regardless of the direction in which the canister 10 tips, the skirt 32 will strike the ground and prevent the canister 10 from falling from its upright position to its side.

Figure 3:
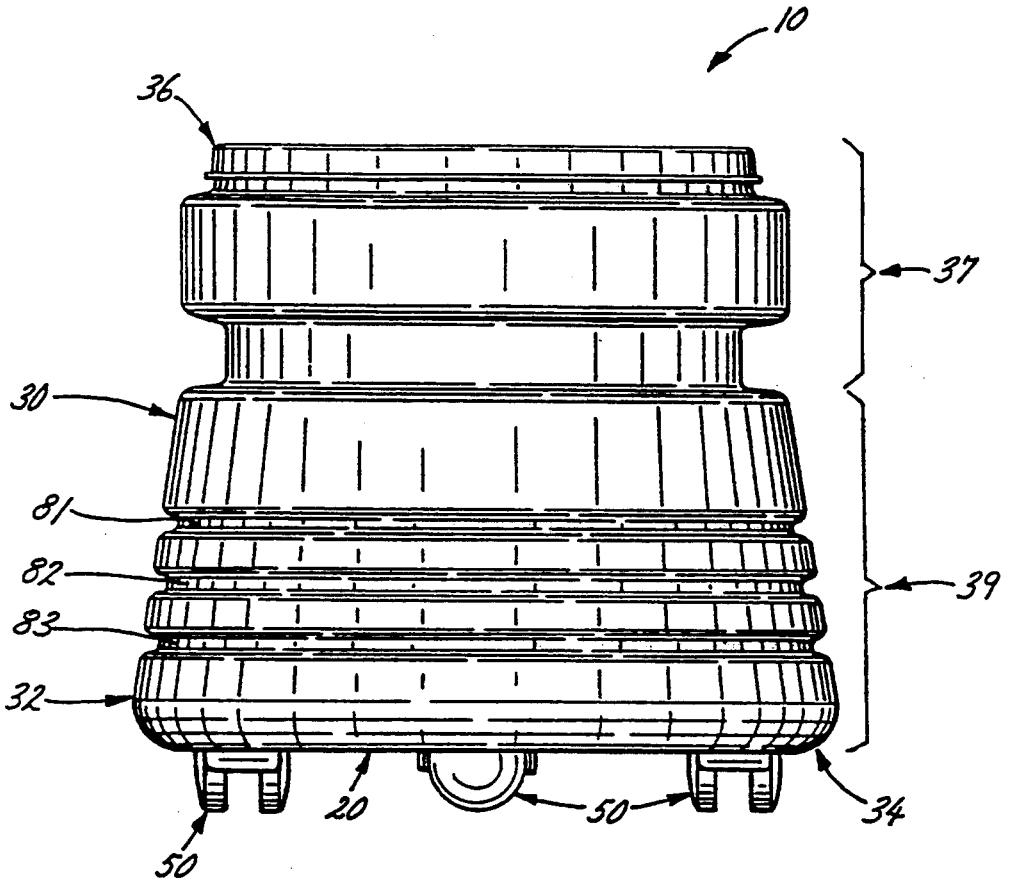
FIG. 3 is a back plan view of the canister.
Figure 8:
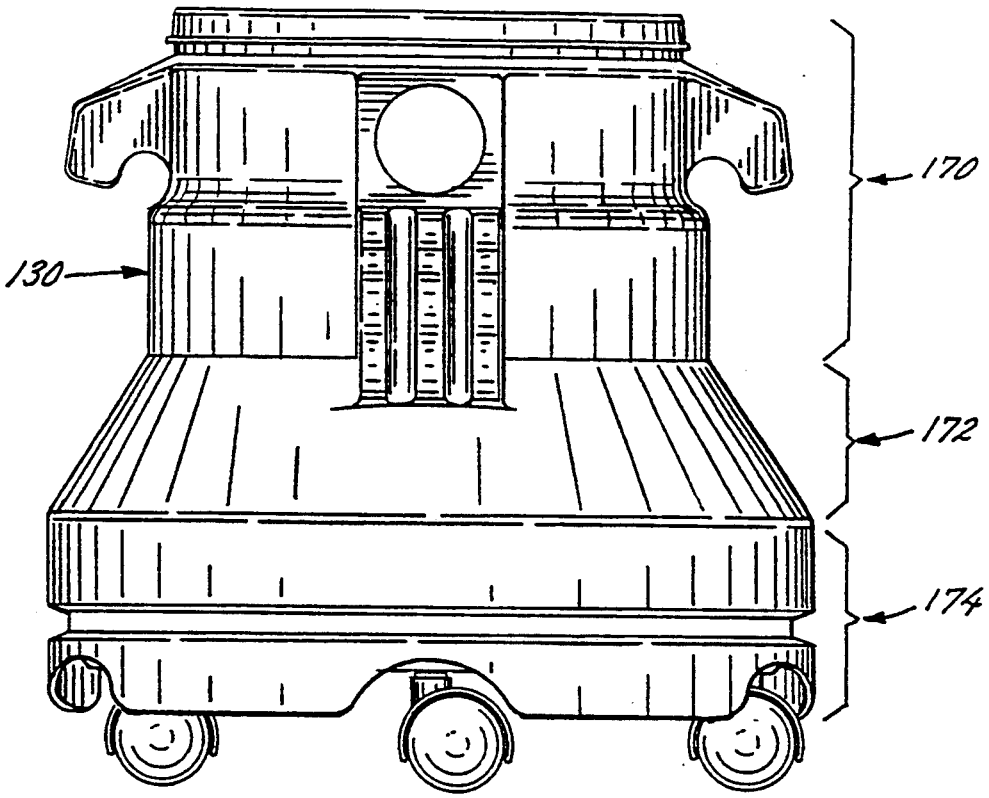
FIG. 8 is a front plan view of a first alternative embodiment of the tip-resistant canister.

As illustrated in FIG. 3, the inventive canister 10 can be constructed in many ways. For instance, the wall 30 can include an upper portion 37 having a substantially cylindrical shape and a lower portion 39 having a substantially conical shape. The canister can also include multiple portions of different shapes and sizes. For example, in the alternative embodiment illustrated in FIG. 8, the canister 130 has three sections, an upper portion 170, an intermediate portion 172 and a lower portion 174. The upper and lower portions 170, 172 each have a substantially cylindrical shape and the intermediate portion 174 has a substantially conical shape. In any embodiment, the canister 10 can also include multiple indentations and protrusions. Thus, as long as the lower end of the canister includes a skirt overhanging the casters to resist tipping, the rest of the canister can be constructed in a wide range of shapes and sizes without departing from the invention. However, it will be appreciated by those skilled in the art, that the canister 10 must be carefully constructed to insure that the skirt 32 strikes the ground before the canister 10 tips beyond a threshold angle from the vertical. If the canister tips beyond this threshold angle, the canister 10 will not be stopped when the skirt 32 strikes the ground but will instead fall completely to its side.

It should be noted that the terms "substantially cylindrical" and "substantially conical" as used in this specification and the accompanying claims are meant only to denote broad, general outlines of the wall 30. Thus, a wall including irregular projections and/or indentations could be either "substantially cylindrical" or "substantially conical" as long as its general shape is cylindrical or conical when the minor surface detailing and structures are ignored. For instance, as illustrated in FIG. 1, the "substantially cylindrical" portion of wall 30 includes port 62 and the "substantially conical" portion of wall 30 includes indented rings 81, 82 and 83 as well as projections 84 and still easily fits these definitions.

Figure 6:
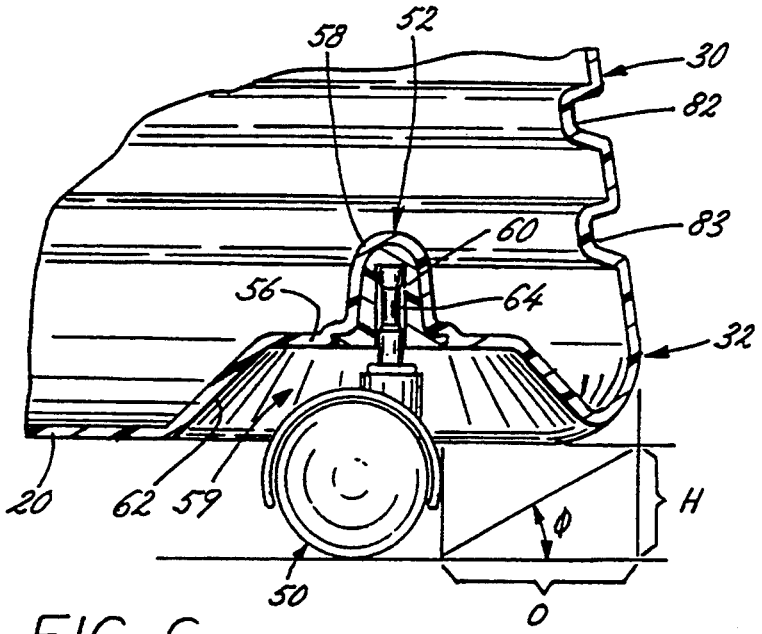
FIG. 6 is a partial cross-sectional view of a recessed caster support of the canister taken along line 6—6 of FIG. 5.

As best seen in FIG. 6, the exaggerated skirt 32 strikes the ground when the canister 10 tips to an angle $\phi$ from its normal upright position. In keeping with the invention, the canister is constructed such that angle $\phi$ is less than the threshold angle. Thus, under normal circumstances, the canister 10 will not tip beyond the angle $\phi$ and fall to its side. Since the angle $\phi$ is governed by the following equation:

$$\text{Tan } \phi = H/O$$

where "H" is the vertical distance between the ground and the canister floor 20, and "O" is the horizontal distance between the caster 50 and the perimeter of the skirt 32, angle $\phi$ can be adjusted by changing the physical characteristics of the canister 10. Specifically, the amount the skirt 32 overhangs the casters 50 (O) can be increased and/or the height of the canister 10 (H) can be decreased to decrease the angle $\phi$. By carefully selecting appropriate parameters (H and O), angle $\phi$ is maintained below the threshold angle.

The exaggerated skirt 32 is preferably constructed to overhang the casters 50 by an amount greater than or equal to the distance between the canister floor 20 and the ground. In other words, as illustrated in FIG. 6, the casters 50 are spaced radially inward from the lower perimeter of wall 30 by a distance "O" which is at least as large as the distance "H", the height at which the canister floor 20 is supported by the casters 50. If the overhang "O" is equal to the distance "H", the skirt 32 will strike a level surface when the canister 10 tips to a 45° angle from the vertical. If the overhang "O" exceeds the height of the canister floor "H", this angle will become correspondingly smaller. Currently, an overhang of $2\frac{1}{8}$ inches (5.40 cm) and a height of $1\frac{1}{8}$ inches (2.86 cm) from the canister floor 20 to the ground is most preferred. For clarity, it should be noted that these numbers reflect the fact that the preferred embodiment includes recessed casters as set forth below.

It will be appreciated by those skilled in the art that a force directed to the right in FIG. 6 will cause the casters 50 to rotate to the position illustrated in that same figure if the force is sufficient to move the canister 10. A similar force directed to the left would cause the casters 50 to rotate 180°. Thus, the effective overhang "O" can vary. However, since the casters 50 rotate to align themselves opposite the direction of the tipping force as explained above, the effective overhang "O" will be maximized on the side of the canister 10 which strikes the ground whenever a tipping force is applied. In other words, the casters 50 will rotate to the position in FIG. 6 whenever a force tending to tip the canister 10 to the right is applied thereby maximizing the overhang "O". When an opposite tipping force is applied, the casters will rotate 180° thereby maximizing the overhand "O" on the opposite side of the canister 10.

Figure 4:
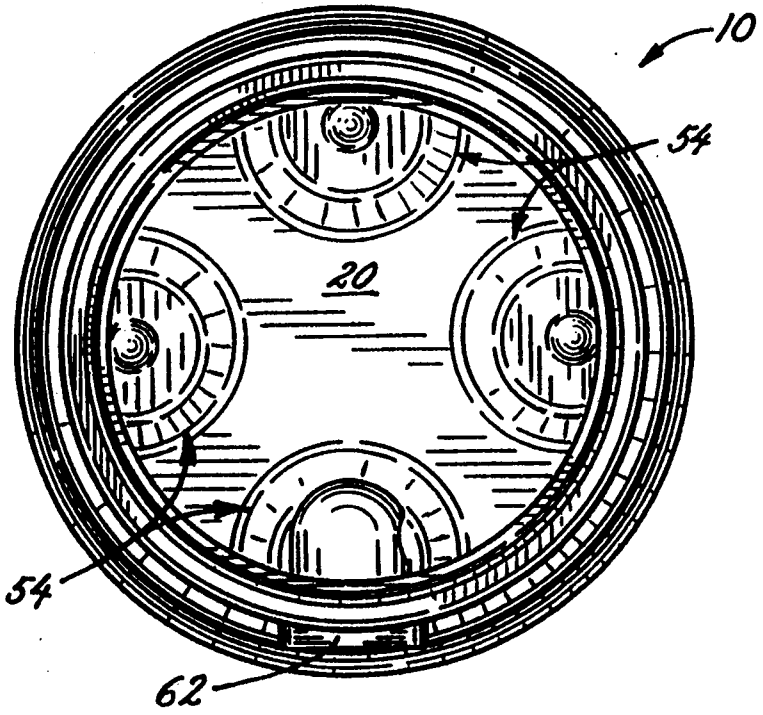
FIG. 4 is a top plan view of the tip-resistant canister illustrating the interior profile of the recessed caster supports.
Figure 5:
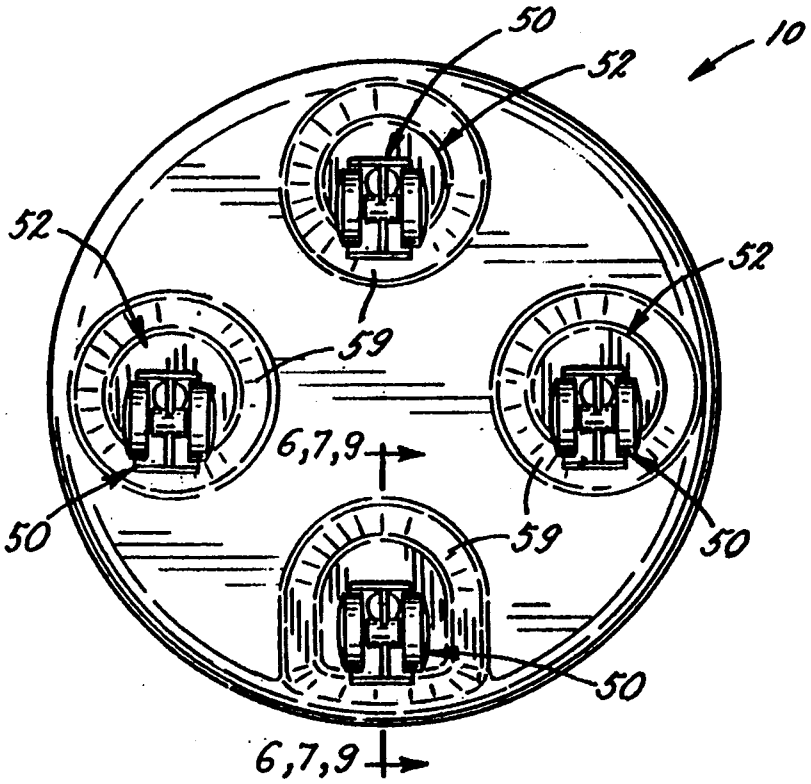
FIG. 5 is a bottom plan view of the canister.

As previously mentioned, the canister floor 20 is generally equipped to receive and support casters 50 which enable the canister 10 to roll over a surface during use and storage. To this end, the canister floor 20 includes caster supports 52 as illustrated in FIG. 5. The caster supports 52 are preferably recessed with respect to the canister floor 20 and thus, the supports 52 form protrusions 54 in the interior of the canister 10 as shown in FIG. 4.

The effectiveness of the exaggerated skirt 32 is increased by these recessed caster supports 52. As discussed above, the distance the canister 10 is permitted to tilt from its normal upright position before the skirt 32 strikes the ground is dependent upon two variables—the horizontal distance between the caster 50 and the perimeter of the skirt 32 (or the overhang, "O"); and, the vertical distance between the ground and the canister floor 20 (or the height, "H"). Recessing the caster supports 52 lowers the height "H" of the canister 10 and thus, limits the distance the canister will tilt before the skirt 32 strikes the ground. In other words, should a vacuum unit incorporating the inventive canister 10 begin to tip, the skirt 32 need only move a short distance before striking the ground. As a result, the vacuum unit will only tilt a small distance from its normal upright position before the self-righting force generated by the exaggerated skirt striking the ground will become effective.

Moreover, as best seen in FIG. 6, the recessed caster supports 52 cause the canister to ride closer to the ground than a conventional canister employing non-recessed casters. This lowers the center of gravity of any vacuum unit in which the canister is used. Since objects with a lower center of gravity are more difficult to tip than objects with a higher center of gravity, the recessed caster supports 52 make the inventive canister 10 more difficult to tip than a conventional canister.

Figure 7:
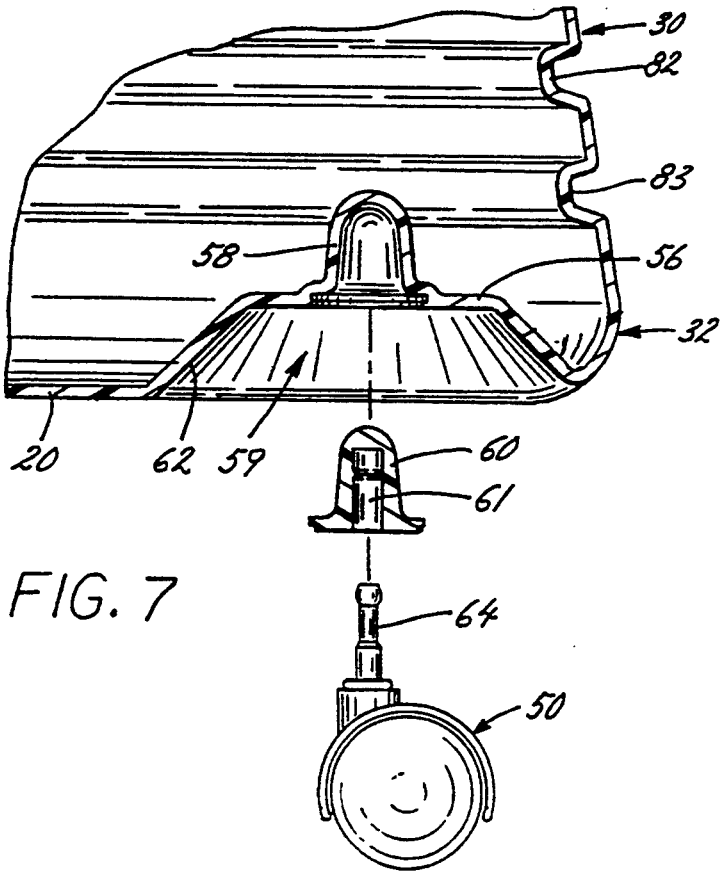
FIG. 7 is an exploded view of the caster support.

As best seen in FIGS. 6 and 7, each caster support 52 preferably includes a circular foundation 56, a dowel sleeve 58 and a dowel sleeve insert 60 which combine to receive and hold a dowel 64 of a caster 50. Further, floor 20 is preferably disposed in a first substantially horizontal plane and the caster supports 52 are preferably disposed in a second substantially horizontal plane to create the recessed effect. The circular foundation 56 is a flat circular area preferably attached to the canister floor 20 by a conical ramp 62. The dowel sleeve 58 is preferably an indentation formed in the center of the circular foundation 56 which is dimensioned to receive and hold the dowel sleeve insert 60. The dowel sleeve insert 60 defines an interior chamber 61 shaped to receive a caster dowel 64. Any caster 50 which is inserted into the dowel sleeve insert 60 will be held in a vertical position and permitted to rotate as illustrated in FIG. 7.

While, as illustrated in FIGS. 1–3, the recessed casters 50 are partially obscured from view by the skirt 32, the free movement of the casters 50 are not inhibited by the presence of the skirt. To this end, each of the conical ramps 62 which connect the floor 20 to the perimeter of the circular foundations 56 are preferably positioned at less than a 45° angle to the floor 20. Each circular foundation 56 and each conical ramp thereby combine to form a recessed caster well 59 which permits an attached caster 50 to rotate 360° about the vertically disposed caster dowel 64 inserted in the dowel sleeve insert 60.

Figure 9:
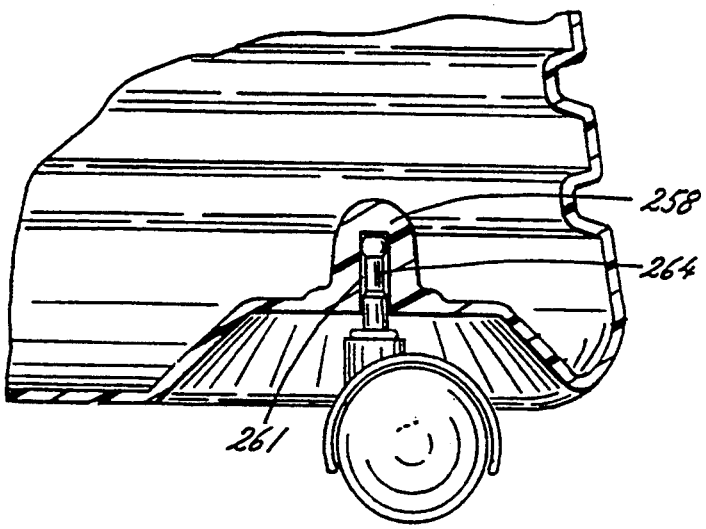
FIG. 9 is a partial cross-sectional view similar to FIG. 6 illustrating an alternative dowel sleeve.

It should be noted that although the above construction for the caster supports 52 is preferred, other variations might likewise be appropriate. For example, as illustrated in FIG. 9, the dowel sleeves 258 could be molded to define an interior chamber 261 which is substantially the same as the chamber 61 included in the dowel sleeve inserts 60 of the preferred embodiment. If this approach is taken the dowel sleeves 258 will receive the caster dowels 264 directly and the dowel sleeve inserts 60 are not used.

Figure 10:
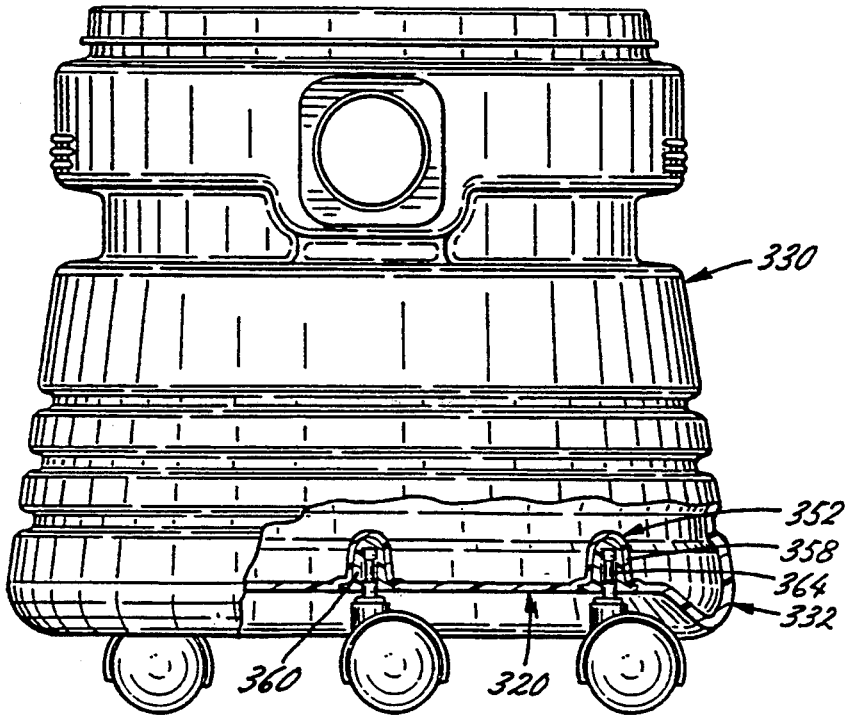
FIG. 10 is a partial cross-sectional view of a second alternative embodiment of the tip-resistant canister.

In another embodiment, the individual caster wells 59 are eliminated and, as illustrated in FIG. 10, most of the floor 320 is substantially recessed in a first substantially horizontal plane above the lower end 334 of the canister wall 330. The floor 320 is then connected to the lower end of the canister wall 330 by a single ramp 362. When this approach is taken, the caster supports 352 (i.e., the dowel sleeves 358 and dowel sleeve inserts 360) can be connected directly to the recessed floor 320 to achieve the lower center of gravity and other advantages associated with recessed casters. Further, if desired, the casters could be recessed even more deeply in the embodiment illustrated in FIG. 10 by molding the caster wells 59 of the preferred embodiment into the already recessed floor 320. Similarly, the dowel sleeves 358 can be equipped to receive the caster dowels 364 directly as in FIG. 9 or to include dowel sleeve inserts 360 as illustrated in FIG. 10.

What is claimed is:

1. A tip-resistant canister for use in vacuum cleaners comprising:

a floor having caster supports;

casters disposed in the caster supports; and a wall connected to the floor and having an upper perimeter and a lower perimeter, the lower perimeter being larger than the upper perimeter and the caster supports being spaced inwardly from the lower perimeter such that the wall forms a skirt for resisting tipping.

2. A tip-resistant canister as defined in claim 1 wherein the floor is positioned in a first substantially horizontal plane and the caster supports are positioned in a second substantially horizontal plane above the first substantially horizontal plane.

3. A tip-resistant canister as defined in claim 2 further comprising ramps connecting the floor to the caster supports to provide recessed cavities, the casters being mounted at least partially within the recessed cavities for free rotation about a vertical axis.

4. A tip-resistant canister as defined in claim 3 wherein each of the caster supports comprises a substantially circular foundation supporting a dowel sleeve for receiving a caster dowel, the dowel sleeve being substantially centrally disposed with respect to the substantially circular foundation, the substantially circular foundation having a perimeter connected to the ramps.

5. A tip-resistant canister as defined in claim 4 further comprising a dowel sleeve insert disposed within the dowel sleeve.

6. A tip-resistant canister as defined in claim 1 wherein each of the caster supports comprises a dowel sleeve for receiving a caster dowel.

7. A tip-resistant canister as defined in claim 1 wherein the wall has a substantially conical shape.

8. A tip-resistant canister as defined in claim 1 wherein the wall has an upper portion and a lower portion, the upper portion having a substantially cylindrical shape and the lower portion having a substantially conical shape.

9. A tip-resistant canister as defined in claim 1 wherein the wall has an upper portion, an intermediate portion and a lower portion, the upper portion and the lower portion having a substantially cylindrical shape, and the intermediate portion having a substantially conical shape.

10. A tip-resistant canister as defined in claim 1 wherein the casters support the lower perimeter of the canister at a first height and are spaced radially inward from the lower perimeter by a distance at least as large as the first height.

11. A tip-resistant canister for use in vacuum cleaners comprising:

a wall having an upper end and a lower end; the upper end having a first perimeter and the lower end having a second perimeter, the second perimeter being larger than the first perimeter such that the lower end forms a skirt for resisting tipping; and a floor connected to the lower end of the wall, a floor portion being positioned in a first substantially horizontal plane above the lower end of the wall and including caster supports for receiving casters.

12. A tip-resistant canister as defined in claim 11 wherein the caster supports are positioned in a second substantially horizontal plane above the first substantially horizontal plane and the floor is connected to the caster supports.

13. A tip-resistant canister as defined in claim 12 wherein the floor is connected to the caster supports by ramps to provide recessed cavities for permitting attached casters to freely rotate about a vertical axis.

14. A tip-resistant canister as defined in claim 13 wherein each of the caster supports comprises a substantially circular foundation supporting a dowel sleeve for receiving a caster dowel, the dowel sleeve being substantially centrally disposed with respect to the substantially circular foundation, the substantially circular foundation having a perimeter connected to the ramps.

15. A tip-resistant canister as defined in claim 14 further comprising a dowel sleeve insert disposed within the dowel sleeve.

16. A tip-resistant canister as defined in claim 11 wherein each of the caster supports comprises a dowel sleeve for receiving a caster dowel.

17. A tip-resistant canister as defined in claim 11 wherein the wall has a substantially conical shape.

18. A tip-resistant canister as defined in claim 11 wherein the wall has an upper portion and a lower portion, the upper portion having a substantially cylindrical shape and the lower portion having a substantially conical shape.

19. A tip-resistant canister as defined in claim wherein the wall has an upper portion, an intermediate portion and a lower portion, the upper portion and the lower portion having a substantially cylindrical shape, and the intermediate portion having a substantially conical shape.

20. A tip-resistant canister as defined in claim 11 further comprising casters connected to the caster supports for supporting the second perimeter at a first height.

21. A tip-resistant canister as defined in claim 20 wherein the casters are spaced radially inward from the second perimeter by a distance at least as large as the first height.

22. A tip-resistant canister for use in vacuum cleaners comprising:

a substantially circular floor having an outer perimeter and including caster supports spaced inwardly from the outer perimeter;

a substantially conical wall having an upper end and a lower end, the lower end being connected to the floor and having a first perimeter, the upper end having a second perimeter which is smaller than the first perimeter such that the lower end forms a skirt for resisting tipping; and a substantially cylindrical wall connected to the upper end of the conical wall.

23. A tip-resistant canister as defined in claim 22 wherein the floor is positioned in a first substantially horizontal plane and the caster supports are positioned in a second substantially horizontal plane above the first substantially horizontal plane.

24. A tip-resistant canister as defined in claim 23 wherein the floor is connected to the caster supports by conical ramps disposed at less than a 45° angle from the first substantially horizontal plane to provide recessed cavities for permitting attached casters to freely rotate about a vertical axis.

25. A tip-resistant canister as defined in claim 24 wherein each of the caster supports comprises a substantially circular foundation supporting a dowel sleeve for receiving a caster dowel, the dowel sleeve being substantially centrally disposed with respect to the substantially circular foundation, the substantially circular foundation having a perimeter connected to the conical ramps.

26. A tip-resistant canister as defined in claim 25 further comprising a dowel sleeve insert disposed within the dowel sleeve.

27. A tip-resistant canister as defined in claim 22 wherein the lower end of the substantially conical wall has a substantially cylindrical shape.

28. A tip-resistant canister as defined in claim 21 further comprising casters connected to the caster supports for supporting the first perimeter at a first height.

29. A tip-resistant canister as defined in claim 28 wherein the casters are spaced radially inward from the first perimeter by a distance at least as large as the first height.

30. A tip-resistant canister as defined in claim 1 wherein the wall is constructed from a resilient material such that the skirt tends to bounce upon striking the ground.

31. A tip-resistant canister as defined in claim 11 wherein at least the lower end of the wall is constructed from a resilient material such that the skirt tends to bounce upon striking the ground.

32. A tip-resistant canister as defined in claim 22 wherein the substantially conical wall is constructed from a resilient material such that the skirt tends to bounce upon striking the ground.

* * * * *

UNITED STATES PATENT AND TRADEMARK OFFICE

CERTIFICATE OF CORRECTION

PATENT NO. : 5,440,780

DATED : August 15, 1995

INVENTOR(S) : Rakocy et al.

It is certified that error appears in the above-indentified patent and that said Letters Patent is hereby corrected as shown below:

Column 8, line 1, the claim should read "as defined in claim 11 wherein..." instead of --as defined in claim wherein...--

Column 8, line 50, the claim should read "as defined in claim 22..." instead of --as defined in claim 21...--

Signed and Sealed this

Twenty-first Day of November, 1995

Bruce Lehman

*Attest:*

BRUCE LEHMAN

*Attesting Officer*

*Commissioner of Patents and Trademarks*